US011094287B2

(12) United States Patent
Xie

(10) Patent No.: US 11,094,287 B2
(45) Date of Patent: Aug. 17, 2021

(54) DATA DRIVING CIRCUIT AND DRIVING METHOD THEREOF, DATA DRIVING SYSTEM AND DISPLAY DEVICE

(71) Applicant: BOE TECHNOLOGY GROUP CO., LTD., Beijing (CN)

(72) Inventor: Hongjun Xie, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/711,351

(22) Filed: Dec. 11, 2019

(65) Prior Publication Data

US 2020/0118522 A1 Apr. 16, 2020

Related U.S. Application Data

(63) Continuation of application No. 15/107,837, filed as application No. PCT/CN2016/070232 on Jan. 6, 2016, now Pat. No. 10,546,552.

(30) Foreign Application Priority Data

Jul. 27, 2015 (CN) ..... 201510446805.3

(51) Int. Cl.

| | |
|---|---|
| ***G09G 3/20*** | (2006.01) |
| ***G09G 5/04*** | (2006.01) |
| ***G09G 5/00*** | (2006.01) |

(52) U.S. Cl.

CPC ..... *G09G 5/04* (2013.01); *G09G 3/2003* (2013.01); *G09G 3/2074* (2013.01); *G09G 5/003* (2013.01);

(Continued)

(58) Field of Classification Search

CPC ..... G09G 5/04; G09G 3/2074; G09G 3/2003; G09G 5/003; G09G 2320/0673;

(Continued)

(56) References Cited

U.S. PATENT DOCUMENTS

2003/0117360 A1* 6/2003 Bu ..... G09G 3/3688 345/90
2007/0290980 A1* 12/2007 Lin ..... G09G 3/3688 345/100

(Continued)

FOREIGN PATENT DOCUMENTS

CN 101363979 11/2009
CN 102013227 A 4/2011

(Continued)

OTHER PUBLICATIONS

"International Search Report and Written Opinion," PCT/CN2016/070232 (dated Feb. 2, 2017).

(Continued)

*Primary Examiner* — Roberto W Flores
(74) *Attorney, Agent, or Firm* — Womble Bond Dickinson (US) LLP

(57) ABSTRACT

The present disclosure provides a data driving circuit and a driving method thereof, a data driving system and a display device. In an embodiment of a data driving circuit, each digital to analog conversion unit is only used for driving sub-pixels of one color, and by controlling on-off of the switch unit, one data line interface unit is enabled to be connected to different digital to analog conversion units when driving sub-pixels of different colors. In this way, a reference voltage can be provided to the digital to analog conversion unit for driving different color display by a single physical Gamma circuit, without having to use a digital Gamma circuit. Therefore, gray scale loss caused by adjustment using the digital Gamma circuit can be avoided fundamentally.

16 Claims, 5 Drawing Sheets

(52) U.S. Cl.
CPC ..... *G09G 2300/0426* (2013.01); *G09G 2300/0452* (2013.01); *G09G 2310/027* (2013.01); *G09G 2310/0291* (2013.01); *G09G 2310/0297* (2013.01); *G09G 2310/08* (2013.01); *G09G 2320/0666* (2013.01); *G09G 2320/0673* (2013.01)

(58) Field of Classification Search
CPC ... G09G 2320/0666; G09G 2310/0297; G09G 2300/0426; G09G 2300/0452; G09G 2310/027; G09G 2310/0291; G09G 2310/08
See application file for complete search history.

(56) References Cited

U.S. PATENT DOCUMENTS

2010/0039453 A1* 2/2010 Chaji ..... G09G 3/3677 345/690
2010/0182349 A1 7/2010 Miyazaki
2012/0249603 A1* 10/2012 Ban ..... G09G 3/3614 345/690
2014/0002510 A1* 1/2014 Woo ..... G09G 5/02 345/690
2015/0220462 A1 8/2015 Kim et al.
2016/0042695 A1* 2/2016 Park ..... G09G 3/3688 345/690
2016/0055803 A1* 2/2016 Kim ..... G09G 3/3291 345/691
2017/0328767 A1 11/2017 Zheng

FOREIGN PATENT DOCUMENTS

CN 102347011 A 2/2012
CN 203287664 U 11/2013
CN 104766564 A 7/2015
CN 104966482 A 10/2015
JP 2012077181 A 2/2012

OTHER PUBLICATIONS

Scully, Op-Amp Buffer, Jan. 2, 2007, TUFTS Robotics Electronics Tutorial, pp. 1-2.
"Office Action," CN Application No. 201510446805.3 (dated Mar. 3, 2017).
"Second Office Action," CN Application No. 201510446805.3 (dated Nov. 23, 2017).

* cited by examiner

DATA DRIVING CIRCUIT AND DRIVING METHOD THEREOF, DATA DRIVING SYSTEM AND DISPLAY DEVICE

RELATED APPLICATIONS

The present application is a continuation application of U.S. Ser. No. 15/107,837, which is the U.S. national phase entry of PCT/CN2016/070232, with an international filing date of Jan. 6, 2016 and claiming the benefit of Chinese Patent Application No. 201510446805.3, filed on Jul. 27, 2015, the entire disclosures of which are incorporated herein by reference.

FIELD

The present disclosure relates to the field of display technology, particularly to a data driving circuit and a driving method thereof, a data driving system and a display device.

BACKGROUND

In the conventional pixel arrangement manner, any output channel of the data driving circuit corresponds to a fixed color. As shown in FIG. 1, the colors of sub-pixels (sub-pixels of column Rm, m is a positive integer) connected by each data line Dm are the same (all are R, all are B or all are G). These output channels are fixedly connected to a digital to analog converter (DAC) of a corresponding color; the digital to analog converter is then connected to a Gamma circuit to which this color corresponds. In this way, different colors would not be mutually influenced.

In displays of Sub Pixel Rendering (SPR) type, one data line is generally connected to sub-pixels of different colors. FIG. 2 shows a possible way of SPR sub-pixel arrangement manner, wherein sub-pixels of column Rm (m=1, 2, 3 . . . ) connected by any data line Dm (m=1, 2, 3 . . . ) contain sub-pixels of three colors (R, G, B). If the Gamma circuits grouped according to colors are still used, it will result in abnormity of the output voltage value. A commonly used solution at present is combining the Gamma input voltages of various colors such that there is only one group of Gamma circuits within the whole chip. Here all the DACs are connected to the same group of Gamma circuits, and perform gray scale operations on the data in the forepart such that the input gray scales of various colors correspond to different voltage values. This is generally called digital Gamma adjustment. Such a method may result in gray scale loss, because not all the gray scales can be displayed for colors of small voltage ranges; moreover, the display quality of the screen is thus declined.

SUMMARY

An object of the present disclosure lies in providing a data driving mechanism which can mitigate or avoid gray scale loss.

In a first aspect, a data driving circuit comprising a plurality of sub-circuits is provided. Each sub-circuit comprises: a plurality of digital to analog conversion units, each digital to analog conversion unit being used for only driving sub-pixels of one color; a plurality of data line interface units, each data line interface unit being connected to one data line; and a plurality of switch units, connected between the plurality of digital to analog conversion units and the plurality of data line interface units, and configured to turn on or off under the control of control signals, so as to enable each of the plurality of data line interface units to be connected to different digital to analog conversion units when driving sub-pixels of different colors.

In an implementation, each data line interface unit comprises an operational amplifier module.

In an implementation, each sub-circuit comprises N adjacent digital to analog conversion units, N adjacent data line interface units and a plurality of switch units connected to the N adjacent digital to analog conversion units and the N adjacent data line interface units, wherein N is a number of types of colors of the sub-pixels.

In an implementation, each digital to analog conversion unit is connected to N adjacent data line interface units via N switch units, and each data line interface unit is connected to N adjacent digital to analog conversion units via N switch units.

In an implementation, the value of N is 3. In each sub-circuit: a first data line interface unit is connected to a first digital to analog conversion unit through a first switch unit, and is connected to a second digital to analog conversion unit through a second switch unit; a second data line interface unit is connected to a second digital to analog conversion unit through a third switch unit, and is connected to a third digital to analog conversion unit through a fourth switch unit; and a third data line interface unit is connected to the third digital to analog conversion unit through a fifth switch unit, and is connected to the first digital to analog conversion unit through a sixth switch unit.

In an implementation, the data driving circuit comprises two switch unit control interfaces for receiving the control signals. Each switch unit is configured to turn on or off in response to levels applied to the two switch unit control interfaces, so that each of the plurality of data line interface units is connected to different digital to analog conversion units when driving sub-pixels of different colors.

In another aspect, a data driving system is provided, comprising the data driving circuit as stated above.

In an implementation, the data driving system further comprises a timing controller. The timing controller is connected with the data driving circuit for providing the control signals, so that each of the plurality of data line interface units is connected to different digital to analog conversion units when driving sub-pixels of different colors.

In an implementation, the data driving circuit comprises two switch unit control interfaces. The control signal is used for controlling level states of the two switch unit control interfaces.

In an implementation, the data driving system further comprises N Gamma circuits, wherein N is a number of types of colors of the sub-pixels. Respective digital to analog conversion units driving sub-pixels of the same color are connected to the same Gamma circuit.

In yet another aspect, a display device is provided, comprising the data driving system as stated above.

In an implementation, each digital to analog conversion unit in the data driving circuit is connected to two data line interface units via two switch units, and each data line interface units are connected to two digital to analog conversion units via two switch units. The display device further comprises a pixel array, the pixel array comprising a plurality of sub-pixel arrays, each sub-pixel array comprising three columns of sub-pixels and three data lines, wherein in each sub-pixel array, a sub-pixel of the 4x+1th row and a sub-pixel of the 4x+3th row of sub-pixels of a first column, a sub-pixel of the 4x+2th row of sub-pixels of a second column, a sub-pixel of the 4x+4th row of sub-pixels of a third column are sub-pixels of a first color; a sub-pixel of the 4x+4th row of sub-pixels of the first column, a sub-pixel of the 4x+1th row and a sub-pixel of the 4x+3th row of sub-pixels of the second column, a sub-pixel of the 4x+2th row of sub-pixels of the third column are sub-pixels of a second color; and other sub-pixels are sub-pixels of a third color, wherein x is an integer greater than or equal to 0, and wherein a first data line is connected to the sub-pixels of the first color in the sub-pixels of the first column and the sub-pixels of the second color in the sub-pixels of the third column in another adjacent sub-pixel array, a second data line is connected to the sub-pixels of the second color in the sub-pixels of the second column and the sub-pixels of the second color and sub-pixels of the third color in the sub-pixels of the first column, and a third data line is connected to the sub-pixels of the third color in the sub-pixels of the third column and the sub-pixels of the first color and the sub-pixels of the third color in the sub-pixels of the second column.

In yet another aspect, a method for driving the data driving circuit as stated above is provided, comprising: providing the control signals to the data driving circuit, so that each of the plurality of data line interface units is connected to different digital to analog conversion units when driving sub-pixels of different colors.

According to embodiments of the present disclosure, by controlling on-off of the switch unit, one data line interface unit is enabled to be connected to different digital to analog conversion units when driving sub-pixels of different colors, and each digital to analog conversion unit is used for only driving sub-pixels of one color. In this way, a reference voltage can be provided to the digital to analog conversion unit for driving different color display by a single physical Gamma circuit, without having to use a digital Gamma circuit. Therefore, gray scale loss caused by adjustment using the digital Gamma circuit can be avoided fundamentally.

DETAILED DESCRIPTION

In order to enable the purposes, technical solutions and advantages of embodiments of the present disclosure to be clearer, next, the embodiments of the present disclosure will be described clearly and completely with reference to the drawings. Apparently, the embodiments to be described are only a part of rather than all of the embodiments of the present disclosure. Based on the embodiments of the present disclosure, all other embodiments obtained by the ordinary skilled person in the art on the premise of not paying any creative work belong to the claimed scope of the present disclosure.

Figure 1:
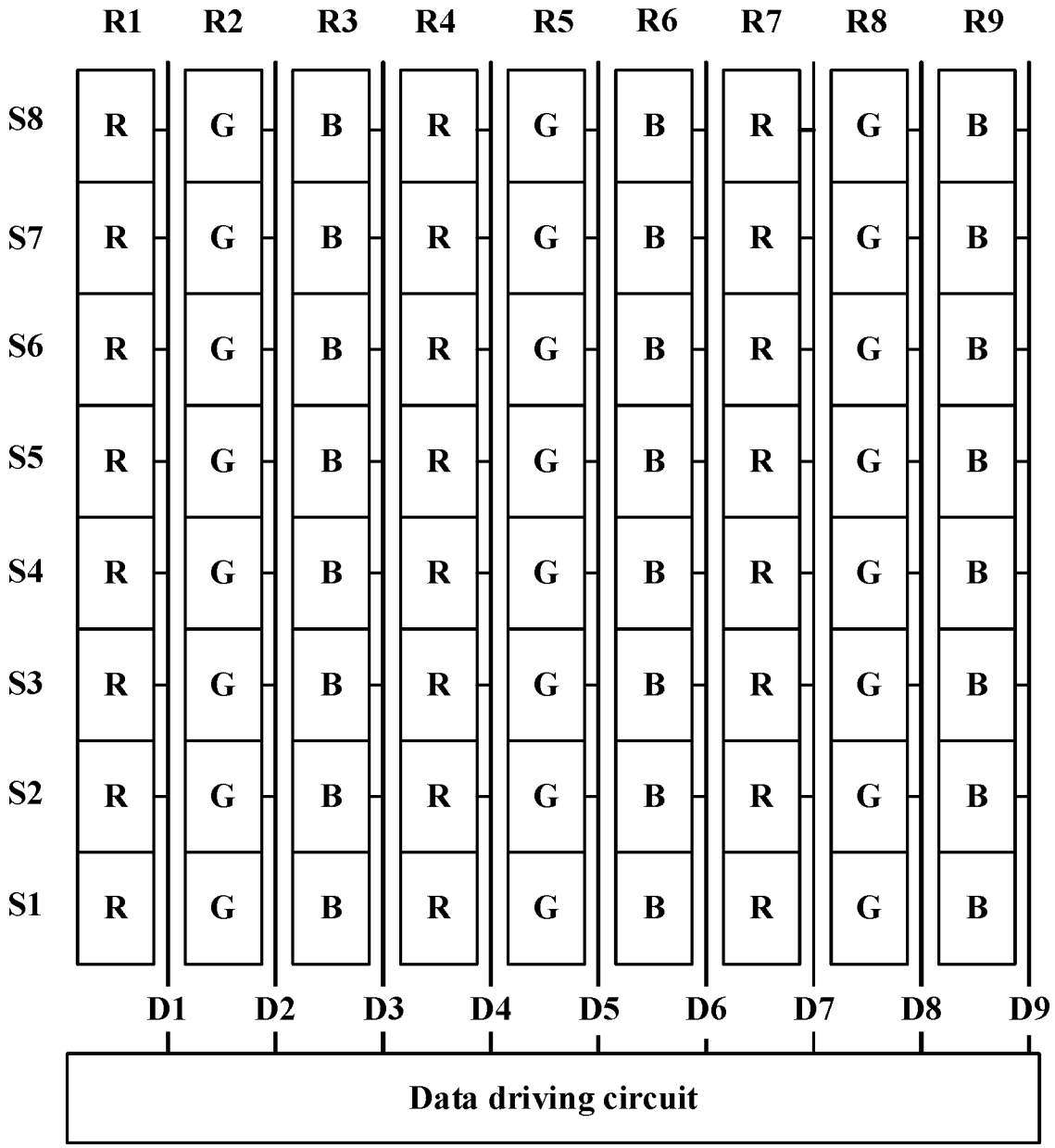
FIG. 1 is a schematic view of a conventional pixel array.
Figure 2:
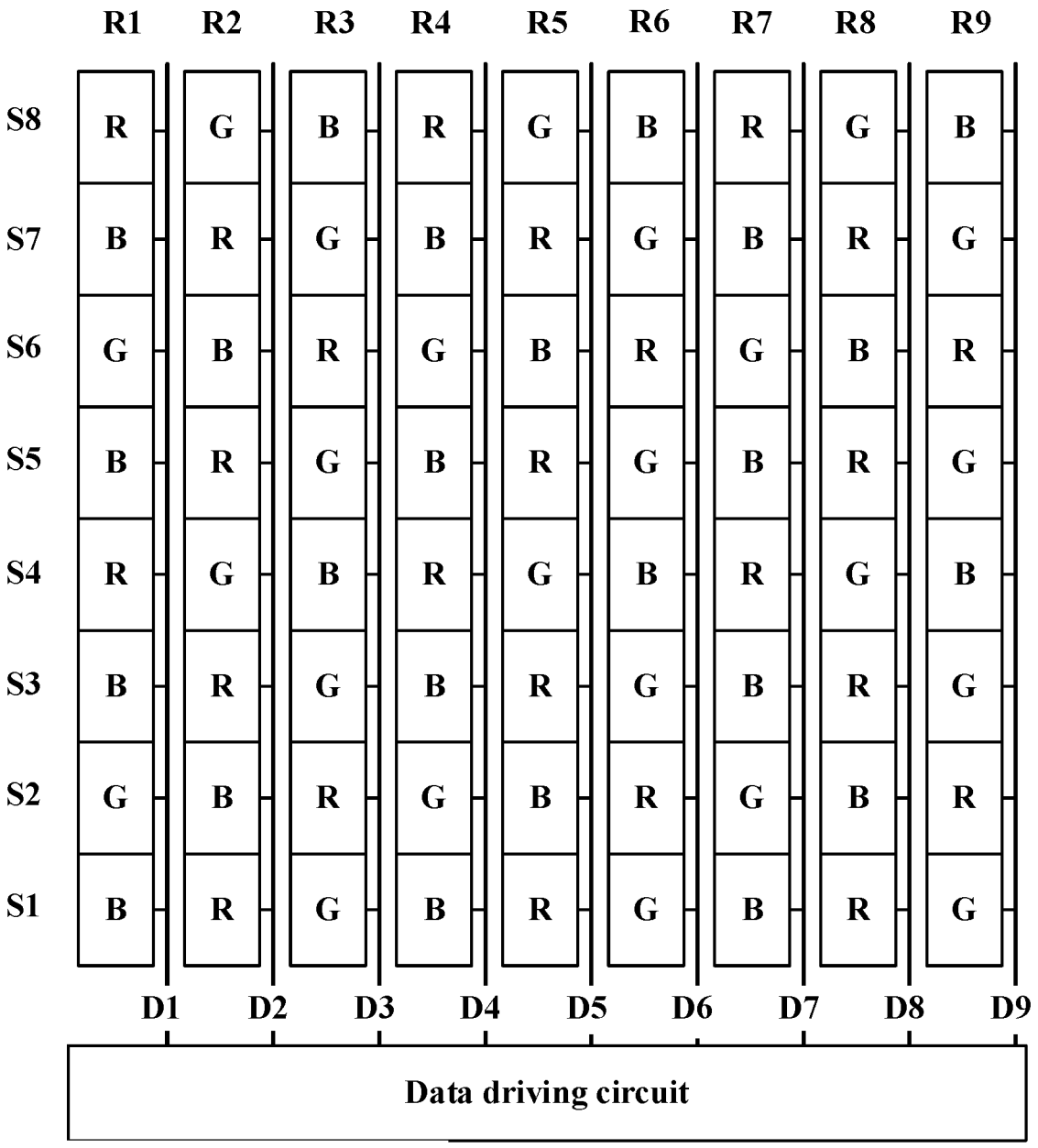
FIG. 2 is a schematic view of a pixel array of a SPR type.

FIG. 2 shows a SPR sub-pixel arrangement manner, wherein sub-pixels of column Rm (m=1, 2, 3 . . . ) connected by any data line Dm (m=1, 2, 3 . . . ) contain sub-pixels of three colors (R, G, B).

Figure 3:
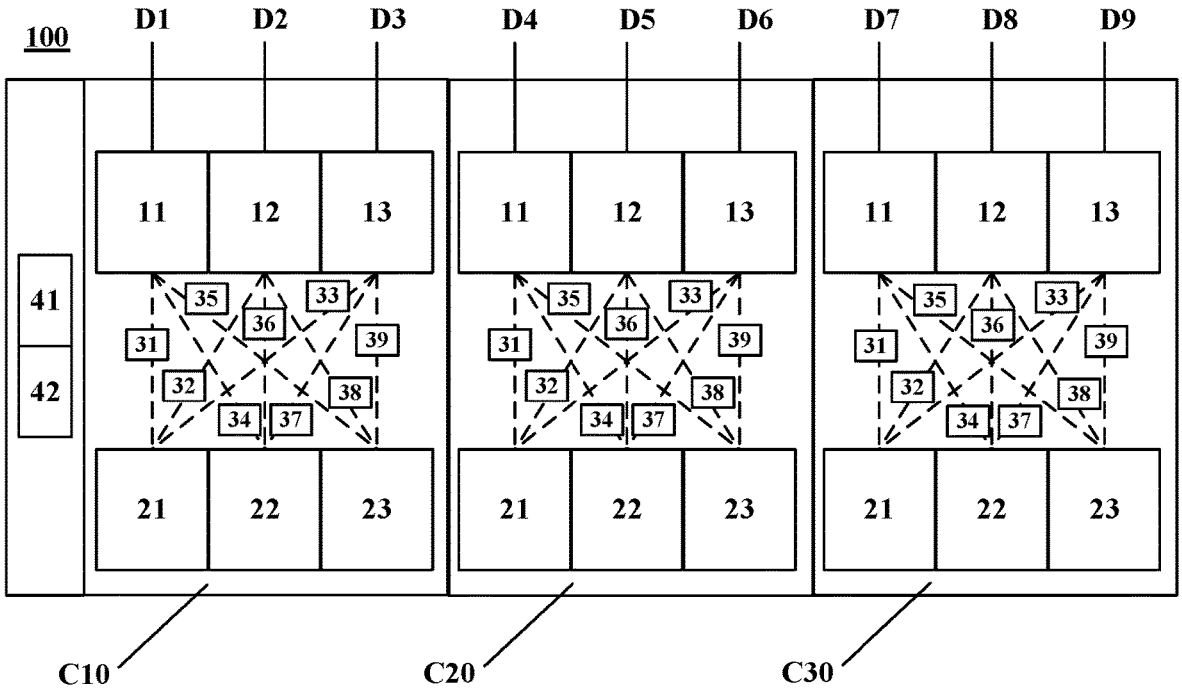
FIG. 3 is a structural schematic view of a data driving circuit is according to an embodiment of the present disclosure.

FIG. 3 shows a data driving circuit 100 according to an embodiment of the present disclosure, which can be used for driving the pixel array as shown in FIG. 2. As shown in FIG. 3, the data driving circuit 100 can comprise a plurality of sub-circuits (as an example, only three of them are shown and marked as C10, C20, C30). In this example, each sub-circuit comprises three data line interface units 11, 12 and 13, three digital to analog conversion units 1, 22 and 23, and nine switch units 31, 32, 33 . . . 39. In each sub-circuit, each data line interface unit 11, 12 and 13 is connected to the three digital to analog conversion units 1, 22 and 23 in the sub-circuit through the three switch units in the sub-circuit respectively, and each digital to analog conversion unit 1, 22 and 23 is also connected to the three data line interface units 11, 12 and 13 in the sub-circuit through the three switch units in the sub-circuit respectively. Specifically, the data line interface unit 11 is connected to the digital to analog conversion unit 1 through the switch unit 31, is connected to the digital to analog conversion unit 22 through the switch unit 34, and is connected to the digital to analog conversion unit 23 through the switch unit 35; the data line interface unit 12 is connected to the digital to analog conversion unit 1 through the switch unit 32, is connected to the digital to analog conversion unit 22 through the switch unit 36, and is connected to the digital to analog conversion unit 23 through the switch unit 38; and the data line interface unit 13 is connected to the digital to analog conversion unit 1 through the switch unit 33, is connected to the digital to analog conversion unit 22 through the switch unit 37, and is connected to the digital to analog conversion unit 23 through the switch unit 39.

The data line interface units 11, 12 and 13 here can be interfaces or interface components for accessing to data lines. In an implementation, each of the data line interface units 11, 12 and 13 can comprise an operational amplifier module OPA. The operational amplifier module OPA can amplify the data voltage outputted by the digital to analog conversion unit and output it to a corresponding data line.

When the data driving circuit 100 as shown in FIG. 3 is driven, the operations of respective groups of sub-circuits can be identical. Next, the driving process of the sub-circuit C10 will be explained with reference to FIGS. 2 and 3.

When the sub-pixels of row S1 are scanned, the switch unit 31 between the digital to analog conversion unit 1 and the data line interface unit 11 is turned on, and other switch units (switch units 32, 33) connected by the digital to analog conversion unit 1 and other switch units (switch units 34, 35) connected by the data line interface unit 11 are turned off, thereby connecting the data line interface unit 11 to the digital to analog conversion unit 1. According to the same manner, the data line interface unit 12 is connected to the digital to analog conversion unit 22, and the data line interface unit 13 is connected to the digital to analog conversion unit 23. In this way, the blue sub-pixel of row S1 and column R1 as shown in FIG. 2 is accessed to the digital to analog conversion unit 1, the red sub-pixel of row S1 and column R2 is accessed to the digital to analog conversion unit 22, and the green sub-pixel of row S1 and column R3 is accessed to the digital to analog conversion unit 23.

When the sub-pixels of row S2 are scanned, by controlling on-off of the respective switch units, the data line interface unit 13 is connected to the digital to analog conversion unit 22, the data line interface unit 11 is connected to the digital to analog conversion unit 23, and the data line interface unit 12 is connected to the digital to analog conversion unit 1. In this way, the blue sub-pixel B of row S2 and column R2 as shown in FIG. 2 is accessed to the digital to analog conversion unit 1, the red sub-pixel of row S2 and column R3 is accessed to the digital to analog conversion unit 22, and the green sub-pixel of row S2 and column R1 is accessed to the digital to analog conversion unit 23.

When the sub-pixels of row S3 are scanned, by controlling on-off of the respective switch units, the data line interface unit 11 is connected to the digital to analog conversion unit 1, the data line interface unit 12 is connected to the digital to analog conversion unit 22, and the data line interface unit 13 is connected to the digital to analog conversion unit 23. In this way, the blue sub-pixel of row S3 and column R1 as shown in FIG. 2 is accessed to the digital to analog conversion unit 1, the red sub-pixel of row S3 and column R2 is accessed to the digital to analog conversion unit 22, and the green sub-pixel of row S3 and column R3 is accessed to the digital to analog conversion unit 23.

When the sub-pixels of row S4 are scanned, by controlling on-off of the respective switch units, the data line interface unit 11 is connected to the digital to analog conversion unit 22, the data line interface unit 12 is connected to the digital to analog conversion unit 23, and the data line interface unit 13 is connected to the digital to analog conversion unit 1. In this way, the blue sub-pixel of row S4 and column R3 as shown in FIG. 2 is accessed to the digital to analog conversion unit 1, the red sub-pixel of row S4 and column R1 is accessed to the digital to analog conversion unit 22, and the green sub-pixel of row S4 and column R2 is accessed to the digital to analog conversion unit 23.

The driving process of the sub-pixels of rows S5-S8 can be identical with the driving process of the sub-pixels of rows S1-S4, which will not be repeated here.

In the above driving process of the data driving circuit 100, for respective columns of sub-pixels driven by one sub-circuit, all blue sub-pixels B are accessed to the digital to analog conversion unit 1, all red sub-pixels R are accessed to the digital to analog conversion unit 22, and all green sub-pixels G are accessed to the digital to analog conversion unit 23. In actual applications, it only needs to connect the digital to analog conversion unit 1 to a physical Gamma circuit for driving the blue sub-pixels, connect the digital to analog conversion unit 22 to a physical Gamma circuit for driving the red sub-pixels, and connect the digital to analog conversion unit 23 to a physical Gamma circuit for driving the green sub-pixels. Since there is no need to use the digital Gamma circuit, gray scale loss caused by adjustment using the digital Gamma circuit can be avoided fundamentally.

Figure 4:
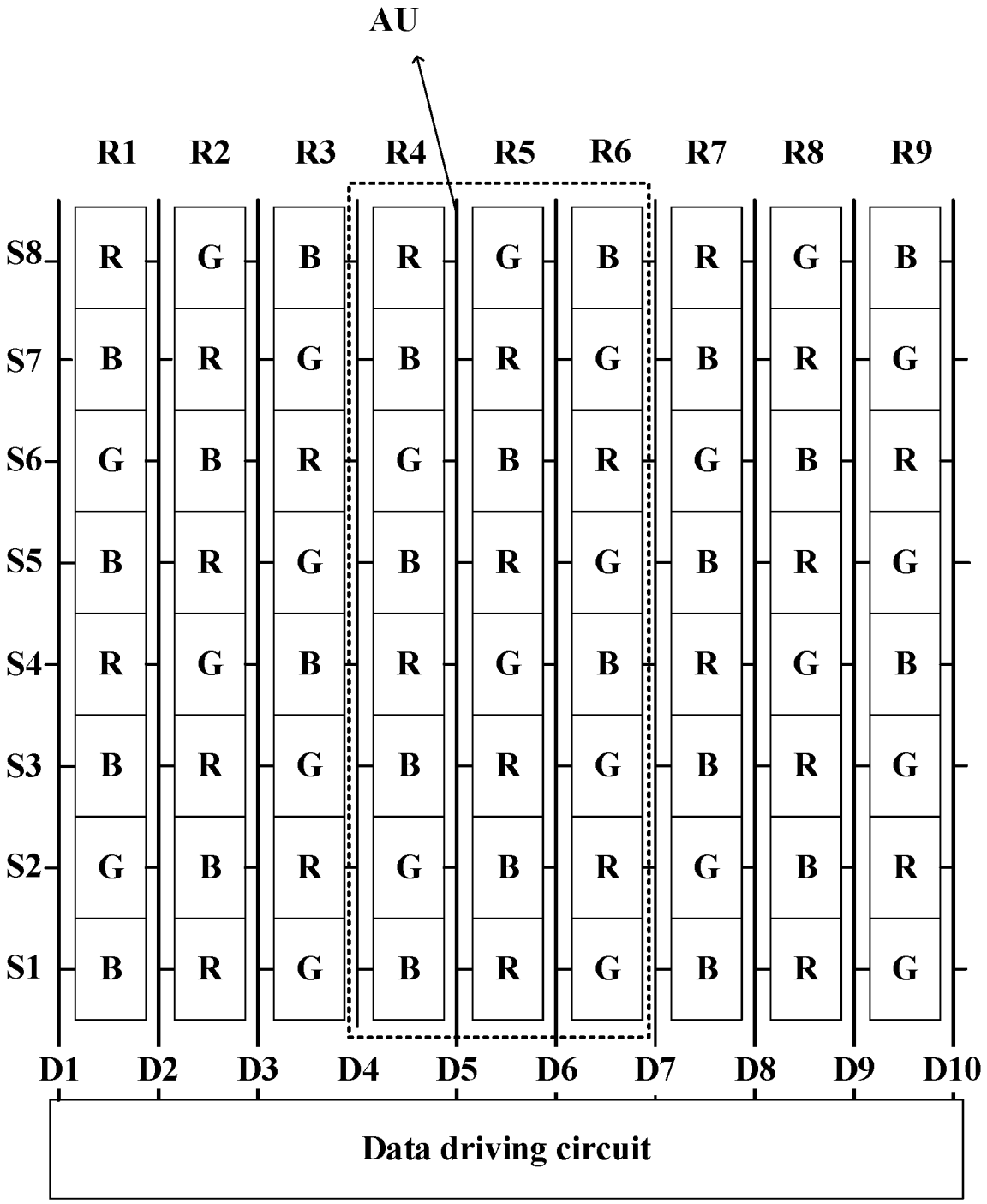
FIG. 4 is a schematic view of another pixel array that can be driven by a data driving circuit according to an embodiment of the present disclosure.

It should be noted that for pixel arrays arranged in different manners, the specific connecting manners of respective switch units in the data driving circuit according to the embodiment of the present disclosure may not be all the same without deviating from the spirit and the scope of the present disclosure. FIG. 4 is another pixel array, which can also be driven by the data driving circuit according to an embodiment of the present disclosure. As shown in FIG. 4, the pixel array comprises a plurality of sub-pixel arrays AU, each of which comprises three columns of sub-pixels and three data lines. Take a sub-pixel array AU containing R4, R5 and R6 columns of sub-pixels and D4, D5 and D6 data lines as an example, a sub-pixel of the 4x+1th (x is an integer greater than or equal to 0) row and a sub-pixel of the 4x+3th row (e.g., row S1 and row S3) of sub-pixels of a first column R4, a sub-pixel of the 4x+2th row (e.g., row S2) of sub-pixels of a second column R5, a sub-pixel of the 4x+4th row (e.g., row S4) of sub-pixels of a third column R6 are blue sub-pixels B; a sub-pixel of the 4x+4th row (e.g., row S4) of sub-pixels of the first column R4, a sub-pixel of the 4x+1th row (e.g., row S1) and a sub-pixel of the 4x+3th row (e.g., row S3) of sub-pixels of the second column R5, a sub-pixel of the 4x+2th row (e.g., row S2) of sub-pixels of the third column R6 are red sub-pixels R; other sub-pixels are green sub-pixels G. The first data line D4 is connected to the blue sub-pixels B in the sub-pixels of column R4 and the red sub-pixels R in the sub-pixels of column R3 in another adjacent sub-pixel array, the second data line D5 is connected to the red sub-pixels R in the sub-pixels of column R5 and the red sub-pixels R and the green sub-pixels G in the sub-pixels of column R4, and the third data line D6 is connected to the green sub-pixels G in the sub-pixels of column R6 and the blue sub-pixels B and the green sub-pixels Gin the sub-pixels of column R5.

Figure 5:
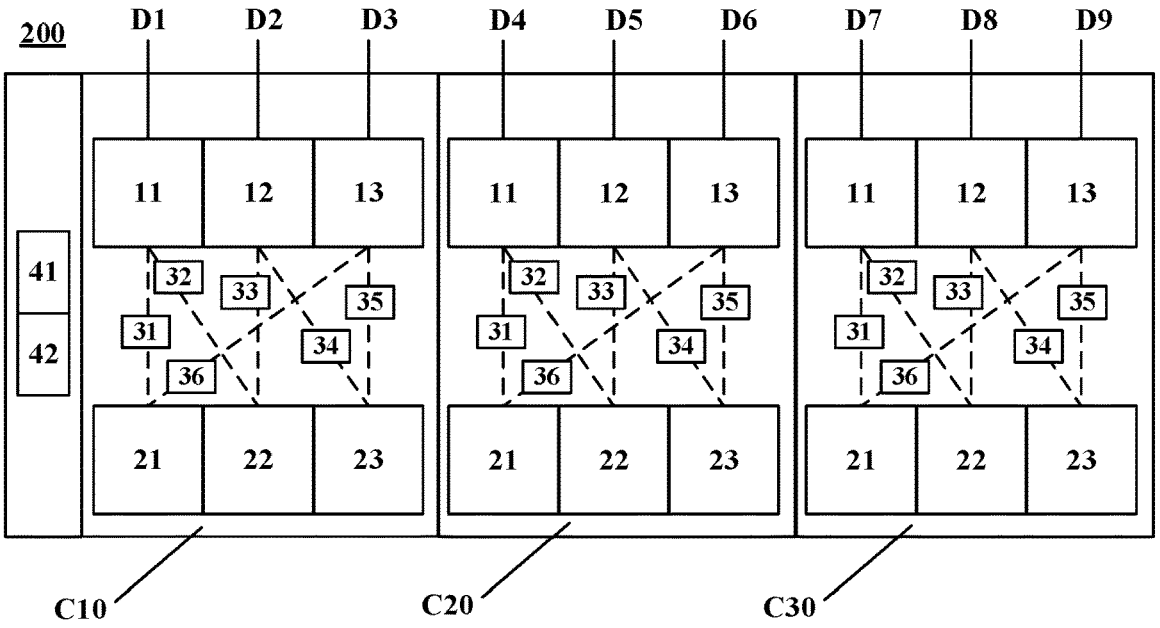
FIG. 5 is a structural schematic view of a data driving circuit according to another embodiment of the present disclosure.

FIG. 5 shows a data driving circuit 200 according to an embodiment of the present disclosure for driving the pixel array as shown in FIG. 4. What differs from the data driving circuit 100 provided by the preceding embodiment is that each sub-circuit of the data driving circuit 200 only comprises six switch units 31, 32, 33, 34, 35, 36. The data line interface unit 11 is connected to the digital to analog conversion unit 1 through the switch unit 31, and is connected to the digital to analog conversion unit 22 through the switch unit 32; the data line interface unit 12 is connected to the digital to analog conversion unit 22 through the switch unit 33, and is connected to the digital to analog conversion unit 23 through the switch unit 34; the data line interface unit 13 is connected to the digital to analog conversion unit 23 through the switch unit 35, and is connected to the digital to analog conversion unit 1 through the switch unit 36. As stated above, each of the data line interface units 11, 12 and 13 can also comprise an operational amplifier module OPA (not shown).

When the data driving circuit 200 is driven, the operations of respective sub-circuits can be identical. Next, the driving process of the sub-circuit C20 will be explained with reference to FIGS. 4 and 5.

When the sub-pixels of row S1 are scanned, by controlling on-off of the respective switch units, the data line interface unit 11 is connected to the digital to analog conversion unit 1, the data line interface unit 12 is connected to the digital to analog conversion unit 22, and the data line interface unit 13 is connected to the digital to analog conversion unit 23. In this way, the blue sub-pixel of row S1 and column R4 is accessed to the digital to analog conversion unit 1, the red sub-pixel of row S1 and column R5 is accessed to the digital to analog conversion unit 22, and the green sub-pixel of row S1 and column R6 is accessed to the digital to analog conversion unit 23.

When the sub-pixels of row S2 are scanned, by controlling on-off of the respective switch units, the data line interface unit 13 is connected to the digital to analog conversion unit 1, the data line interface unit 11 is connected to the digital to analog conversion unit 22, and the data line interface unit 12 is connected to the digital to analog conversion unit 23. In this way, the red sub-pixel of row S2 and column R3 is accessed to the digital to analog conversion unit 22, the green sub-pixel of row S2 and column R4 is accessed to the digital to analog conversion unit 23, and the blue sub-pixel of row S2 and column R5 is accessed to the digital to analog conversion unit 1.

When the sub-pixels of row S3 are scanned, by controlling on-off of the respective switch units, the data line interface unit 11 is connected to the digital to analog conversion unit 1, the data line interface unit 12 is connected to the digital to analog conversion unit 22, and the data line interface unit 13 is connected to the digital to analog conversion unit 23. In this way, the blue sub-pixel of row S3 and column R4 is accessed to the digital to analog conversion unit 1 the red sub-pixel of row S3 and column R5 is accessed to the digital to analog conversion unit 22, and the green sub-pixel of row S3 and column R6 is accessed to the digital to analog conversion unit 23.

When the sub-pixels of row S4 are scanned, by controlling on-off of the respective switch units, the data line interface unit 11 is connected to the digital to analog conversion unit 1, the data line interface unit 12 is connected to the digital to analog conversion unit 22, and the data line interface unit 13 is connected to the digital to analog conversion unit 23. In this way, the red sub-pixel of row S4 and column R3 is accessed to the digital to analog conversion unit 22, the green sub-pixel of row S4 and column R4 is accessed to the digital to analog conversion unit 23, and the blue sub-pixel of row S4 and column R5 is accessed to the digital to analog conversion unit 1.

The driving process of the sub-pixels of rows S5-S8 can be identical with the driving process of the sub-pixels of rows S1-S4, which will not be repeated here.

In the above driving process of the data driving circuit 200, for respective columns of sub-pixels driven by one sub-circuit, all blue sub-pixels B are accessed to the digital to analog conversion unit 1, all red sub-pixels R are accessed to the digital to analog conversion unit 22, and all green sub-pixels G are accessed to the digital to analog conversion unit 23. In actual applications, it only needs to connect the digital to analog conversion unit 1 to a physical Gamma circuit for driving the blue sub-pixels, connect the digital to analog conversion unit 22 to a physical Gamma circuit for driving the red sub-pixels, and connect the digital to analog conversion unit 23 to a physical Gamma circuit for driving the green sub-pixels. Since there is no need to use the digital Gamma circuit, gray scale loss caused by adjustment using the digital Gamma circuit can be avoided fundamentally.

It can be seen that the data driving circuits 100, 200 according to the embodiments of the present disclosure can use a single physical Gamma circuit to drive a pixel array in which one data line is connected to sub-pixels of a plurality of different colors, so as to avoid gray scale loss caused by adjustment using digital Gamma circuits.

It should be understood that although the above embodiments are explained with respect to the number N of types of the colors of the sub-pixels is three (red, green, blue), in actual application, the colors of the sub-pixels can also be four or more. In such a case, one digital to analog conversion unit can still be connected to N data line interface units through N switch units, and one data line interface unit can be connected to N digital to analog conversion units through N switch units. Each data line interface unit can, when driving sub-pixels of a particular color, be connected to a digital to analog conversion unit to which the particular color corresponds. Such a technical solution still falls within the scope of the present disclosure.

In addition, in the above embodiments, the arrangement manner of the sub-pixels of the Zth row and the sub-pixels of the Z+4Yth (Z, Y are both integers) row and the connection relationship with the data lines are completely the same, as shown in FIGS. 2 and 4. That is to say, the pixel array is arranged by taking four rows of sub-pixels as a period. In such a case, switching states of all switch units can have four combinations, corresponding to four rows of sub-pixels in one period. As shown in FIGS. 3 and 5, the data driving circuits 100, 200 can comprise two switch unit control interfaces 41 and 42 for receiving control signals. The level states of the two switch unit control interfaces 41 and 42 have four combinations totally (00, 01, 10, 11, wherein 1 can represent a high level), corresponding to four switching states of the switch unit. In this way, four different switch connection states can be realized by controlling the level states of the switch unit control interfaces 41 and 42 using control signals. Here, the respective switch units can be configured to turn on or off in response to levels applied to the two switch unit control interfaces 41 and 42, so that one data line interface unit is connected to different digital to analog conversion units when driving sub-pixels of different colors.

For different sub-pixel arrangements, there are generally no more than four types of sub-pixel rows. Hence, corresponding control can be realized by four or less switch state combinations. Certainly, when there are more than four switch state combinations being required, more than two switch unit control interfaces can be used.

Figure 6:
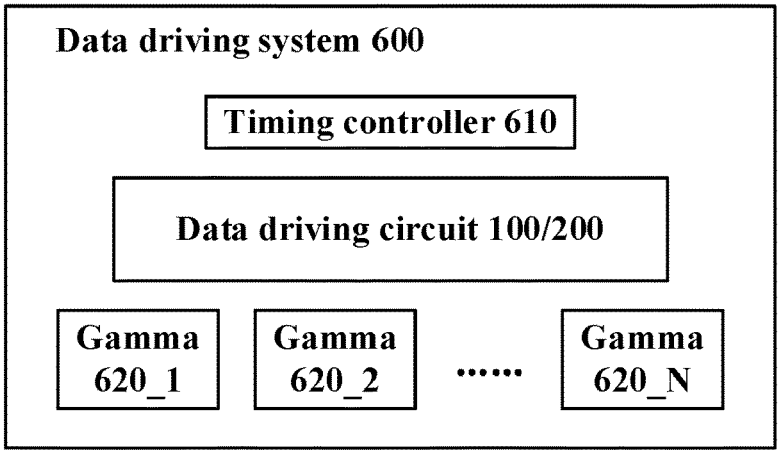
FIG. 6 is a schematic view of a data driving system according to an embodiment of the present disclosure.

FIG. 6 shows a data driving system 600 according to an embodiment of the present disclosure. The data driving system 600 comprises the above data driving circuit 100/200. Further, the data driving system 600 can further comprise a timing controller 610. The timing controller 610 is used for providing control signals to the data driving circuit 100/200 so as to control on-off of each switch unit, so that one data line interface unit is connected to different digital to analog conversion units when driving sub-pixels of different colors. In an example where the data driving circuit comprises two switch unit control interfaces, the timing controller 610 can control on-off of respective switch units by controlling the level states of the two switch unit control interfaces.

As shown in FIG. 6, the data driving system 600 can also comprise N Gamma circuits Gamma_1, Gamma_2 . . . Gamma_N. The digital to analog conversion units driving sub-pixels of the same color are connected to the same Gamma circuit, while the digital to analog conversion units driving sub-pixels of different colors are connected to different Gamma circuits. Here N is a number of types of colors of the sub-pixels used by color display.

Figure 7:
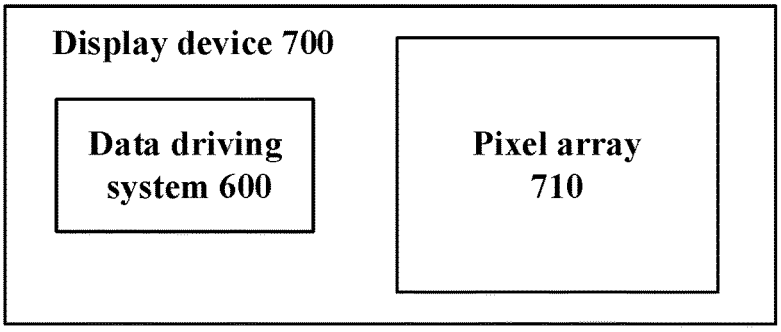
FIG. 7 is a schematic view of a display device according to an embodiment of the present disclosure.

FIG. 7 shows a display device 700 according to an embodiment of the present disclosure. The display device 700 comprises the above data driving system 600. In one implementation, the display device 700 can further comprise a pixel array 710. The pixel array 710 can be the pixel array as shown in FIG. 4, and will not be repeated here. Here, the data driving circuit comprised in the data driving system 600 is the data driving circuit 200 as shown in FIG. 5. In actual applications, the display device 700 can be any product or component having a display function such as electronic paper, a mobile phone, a tablet computer, a television, a display, a laptop, a digital photo frame, a navigator etc.

In another aspect of the present disclosure, a method for driving the above data driving circuit is also provided, comprising: providing the control signals to the data driving circuit, so that each of the plurality of data line interface units is connected to different digital to analog conversion units when driving sub-pixels of different colors.

What is stated above are only specific embodiments of the present disclosure; however, the claimed scope of the present disclosure is not limited to this. Any modifications or replacements that can be easily conceived by the skilled person familiar with the present technical field on the basis of the specific embodiments disclosed should be covered within the claimed scope of the present disclosure. Therefore, the claimed scope of the present disclosure is only defined by the claims attached.

The invention claimed is:

1. A data driving circuit, comprising a plurality of sub-circuits, each sub-circuit comprising:

a plurality of digital to analog conversion units, each digital to analog conversion unit being used for only driving sub-pixels of one color;

a plurality of data line interface units, each data line interface unit being connected to one data line, each data line being connected to sub-pixels of a plurality of different colors; and a plurality of switch units, connected between the plurality of digital to analog conversion units and the plurality of data line interface units, and configured to turn on or off under the control of control signals, so as to enable each of the plurality of data line interface units to be connected to different digital to analog conversion units when driving sub-pixels of different colors;

wherein each sub-circuit comprises N adjacent digital to analog conversion units, N adjacent data line interface units and a plurality of switch units connected to the N adjacent digital to analog conversion units and the N adjacent data line interface units, wherein N is a number of types of all colors of the sub-pixels;

wherein, in each sub-circuit, each data line interface unit is connected to M digital to analog conversion units via respective M switch units of the plurality of switch units, a data line connecting to the data line interface unit is connected to sub-pixels of M colors, and the M digital to analog conversion units are configured to drive said sub-pixels of respective colors of said M colors, wherein $1<M<N$;

wherein a value of M is 2 and a value of N is 3, and wherein in each sub-circuit:

a first data line interface unit is connected to a first digital to analog conversion unit through a first switch unit, and is connected to a second digital to analog conversion unit through a second switch unit;

a second data line interface unit is connected to a second digital to analog conversion unit through a third switch unit, and is connected to a third digital to analog conversion unit through a fourth switch unit; and a third data line interface unit is connected to a third digital to analog conversion unit through a fifth switch unit, and is connected to a first digital to analog conversion unit through a sixth switch unit.

2. The data driving circuit as claimed in claim 1, wherein each data line interface unit comprises an operational amplifier module.

3. The data driving circuit as claimed in claim 1, wherein the data driving circuit comprises two switch unit control interfaces for receiving the control signals, and wherein each switch unit is configured to turn on or off in response to levels applied to the two switch unit control interfaces, so that each of the plurality of data line interface units is connected to different digital to analog conversion units when driving sub-pixels of different colors.

4. A data driving system, comprising a data driving circuit as claimed in claim 1.

5. The data driving system as claimed in claim 4, further comprising a timing controller connected with the data driving circuit for providing the control signals, so that each of the plurality of data line interface units is connected to different digital to analog conversion units when driving sub-pixels of different colors.

6. The data driving system as claimed in claim 4, wherein the data driving circuit comprises two switch unit control interfaces for receiving the control signals, and wherein each switch unit is configured to turn on or off in response to levels applied to the two switch unit control interfaces, so that each of the plurality of data line interface units is connected to different digital to analog conversion units when driving sub-pixels of different colors, and wherein the control signals are used for controlling level states of the two switch unit control interfaces.

7. The data driving system as claimed in claim 4, further comprising N Gamma circuits, wherein N is a number of types of colors of the sub-pixels, wherein respective digital to analog conversion units driving sub-pixels of the same color are connected to a single Gamma circuit.

8. The data driving circuit as claimed in claim 4, wherein each data line interface unit comprises an operational amplifier module.

9. A display device, comprising a data driving system as claimed in claim 4.

10. The display device as claimed in claim 9, wherein the data driving system further comprises a timing controller connected with the data driving circuit for providing the control signals, so that each of the plurality of data line interface units is connected to different digital to analog conversion units when driving sub-pixels of different colors.

11. The display device as claimed in claim 9, wherein the data driving circuit comprises two switch unit control interfaces for receiving the control signals, and wherein each switch unit is configured to turn on or off in response to levels applied to the two switch unit control interfaces, so that each of the plurality of data line interface units is connected to different digital to analog conversion units when driving sub-pixels of different colors, and wherein the control signals are used for controlling level states of the two switch unit control interfaces.

12. The display device as claimed in claim 9, wherein the data driving system further comprises N Gamma circuits, wherein N is a number of types of colors of the sub-pixels, wherein respective digital to analog conversion units driving sub-pixels of the same color are connected to a single Gamma circuit.

13. The display device as claimed in claim 9, wherein each data line interface unit comprises an operational amplifier module.

14. The display device as claimed in claim 9, further comprising a pixel array, the pixel array comprising a plurality of sub-pixel arrays, each sub-pixel array comprising three columns of sub-pixels and three data lines, wherein in each sub-pixel array, a sub-pixel of the 4x+1th row and a sub-pixel of the 4x+3th row of sub-pixels of a first column, a sub-pixel of the 4x+2th row of sub-pixels of a second column, a sub-pixel of the 4x+4th row of sub-pixels of a third column are sub-pixels of a first color; a sub-pixel of the 4x+4th row of sub-pixels of the first column, a sub-pixel of the 4x+1th row and a sub-pixel of the 4x+3th row of sub-pixels of the second column, a sub-pixel of the 4x+2th row of sub-pixels of the third column are sub-pixels of a second color; and other sub-pixels are sub-pixels of a third color, wherein x is an integer greater than or equal to 0, and wherein a first data line is connected to the sub-pixels of the first color in the sub-pixels of the first column and the sub-pixels of the second color in the sub-pixels of the third column in another adjacent sub-pixel array, a second data line is connected to the sub-pixels of the second color in the sub-pixels of the second column and the sub-pixels of the second color and sub-pixels of the third color in the sub-pixels of the first column, and a third data line is connected to the sub-pixels of the third color in the sub-pixels of the third column and the sub-pixels of the first color and the sub-pixels of the third color in the sub-pixels of the second column.

15. A method for driving a data driving circuit, the data driving circuit comprising a plurality of sub-circuits, each sub-circuit comprising: N adjacent digital to analog conversion units, N adjacent data line interface units and a plurality of switch units connected to the N adjacent digital to analog conversion units and the N adjacent data line interface units, wherein N is a number of types of all colors of the sub-pixels, each digital to analog conversion unit being used for only driving sub-pixels of one color; each data line interface unit being connected to one data line, each data line being connected to sub-pixels of a plurality of different colors; and said plurality of switch units being connected between the plurality of digital to analog conversion units and the plurality of data line interface units, and configured to turn on or off under the control of control signals, so as to enable each of the plurality of data line interface units to be connected to different digital to analog conversion units when driving sub-pixels of different colors; wherein, in each sub-circuit, each data line interface unit is connected to M digital to analog conversion units via respective M switch units of the plurality of switch units, a data line connecting to the data line interface unit is connected to sub-pixels of M colors, and the M digital to analog conversion units are configured to drive said sub-pixels of respective colors of said M colors, wherein $1<M<N$, wherein a value of M is 2 and a value of N is 3, and wherein in each sub-circuit: a first data line interface unit is connected to a first digital to analog conversion unit through a first switch unit, and is connected to a second digital to analog conversion unit through a second switch unit; a second data line interface unit is connected to a second digital to analog conversion unit through a third switch unit, and is connected to a third digital to analog conversion unit through a fourth switch unit; and a third data line interface unit is connected to a third digital to analog conversion unit through a fifth switch unit, and is connected to a first digital to analog conversion unit through a sixth switch unit;

the method comprising:

providing the control signals to the data driving circuit, so that each of the plurality of data line interface units is connected to different digital to analog conversion units when driving sub-pixels of different colors.

16. The method as claimed in claim 15, wherein the data driving circuit comprises two switch unit control interfaces for receiving the control signals, and wherein each switch unit is configured to turn on or off in response to levels applied to the two switch unit control interfaces, so that each of the plurality of data line interface units is connected to different digital to analog conversion units when driving sub-pixels of different colors.

* * * * *